US010203095B2

(12) United States Patent
Ye et al.

(10) Patent No.: US 10,203,095 B2
(45) Date of Patent: Feb. 12, 2019

(54) HELMET WITH HIDDEN LIGHT SOURCES AND METHOD FOR MANUFACTURING SAME

(71) Applicant: Shenzhen Qianhai LIVALL IoT Technology Co., Ltd., Shenzhen, Guangdong Province (CN)

(72) Inventors: Yong-Zheng Ye, Shenzhen (CN); Bo Zheng, Shenzhen (CN); Zhi-Ming Li, Nanchong (CN)

(73) Assignee: SHENZHEN QIANHAI LIVALL IOT TECHNOLOGY CO., LTD., Shenzhen, Guangdong Province (CN)

( * ) Notice: Subject to any disclaimer, the term of this patent is extended or adjusted under 35 U.S.C. 154(b) by 12 days.

(21) Appl. No.: 15/413,408

(22) Filed: Jan. 23, 2017

(65) Prior Publication Data

US 2018/0180262 A1 Jun. 28, 2018

(30) Foreign Application Priority Data

Dec. 28, 2016 (CN) ..... 2016 1 1233605

(51) Int. Cl.

| | |
|---|---|
| ***F21V 21/084*** | (2006.01) |
| ***F21V 19/00*** | (2006.01) |
| ***A42B 3/04*** | (2006.01) |
| ***F21V 17/10*** | (2006.01) |
| ***F21V 15/04*** | (2006.01) |
| ***A42C 2/00*** | (2006.01) |

(Continued)

(52) U.S. Cl.

CPC ..... *F21V 19/002* (2013.01); *A42B 3/044* (2013.01); *A42C 2/002* (2013.01); *F21V 3/02* (2013.01); *F21V 15/04* (2013.01); *F21V 17/101* (2013.01); *F21V 21/084* (2013.01); *F21V 33/008* (2013.01); *F21Y 2115/10* (2016.08); *F21Y 2115/15* (2016.08)

(58) Field of Classification Search

CPC ..... A42B 3/044; A42B 3/0446; A42B 3/0453; F21V 17/101; F21V 19/002; F21V 15/04; A42C 2/002

See application file for complete search history.

(56) References Cited

U.S. PATENT DOCUMENTS 4,559,586 A * 12/1985 Slarve ..... B60Q 1/2676 340/432
5,871,271 A * 2/1999 Chien ..... A42B 3/044 362/103

(Continued)

*Primary Examiner* — Alan B Cariaso
(74) *Attorney, Agent, or Firm* — Cheng-Ju Chiang

(57) ABSTRACT

A method for manufacturing a helmet with hidden light sources includes: fixing a helmet housing with at least one light transmitting portion to a base mold; providing a light source protector and a light source belt, and fixing the light source protector to the light source belt, wherein the light source belt comprises a circuit board and a plurality of light sources mounted on, wherein the light source protector comprises a plurality of accommodating holes corresponding to the light sources one by one, and the light sources each are received in a corresponding accommodating hole and enclosed by the light source protector and the circuit board; aligning the light sources to the light transmitting portion and fixing the light source protector to an inner surface of the helmet housing; and injecting a buffer material into the base mold to form a base.

3 Claims, 3 Drawing Sheets

(51) Int. Cl.

| | |
|---|---|
| ***F21V 33/00*** | (2006.01) |
| ***F21V 3/02*** | (2006.01) |
| *F21Y 115/10* | (2016.01) |
| *F21Y 115/15* | (2016.01) |

(56) References Cited

U.S. PATENT DOCUMENTS

| | | | | |
|---|---|---|---|---|
| 6,328,454 | B1 * | 12/2001 | Davis | A42B 3/044 362/105 |
| 7,075,250 | B2 * | 7/2006 | Colwell | A42B 3/044 315/185 R |
| 7,128,434 | B1 * | 10/2006 | Nally | A42B 3/044 362/105 |
| 7,901,104 | B2 * | 3/2011 | McLean | A42B 3/044 362/105 |
| 8,192,043 | B2 * | 6/2012 | Lombard | A42B 3/044 362/106 |
| 8,350,486 | B2 * | 1/2013 | Bucalo | H05B 33/0803 315/209 R |
| 8,562,166 | B1 * | 10/2013 | Kutnyak | G09F 21/026 362/106 |

* cited by examiner

HELMET WITH HIDDEN LIGHT SOURCES AND METHOD FOR MANUFACTURING SAME

CROSS-REFERENCE TO RELATED APPLICATION AND CLAIM OF PRIORITY

This application claims priority of a China patent application serial No. 201611233605.0, titled "HELMET WITH HIDDEN LIGHT SOURCES AND METHOD FOR MANUFACTURING SAME" and filed on Dec. 28, 2016, the contents of which are incorporated by reference herein in their entirety for all intended purposes.

TECHNICAL FIELD

The present disclosure relates to a helmet, and more particularly, to a helmet with hidden light sources and a method for manufacturing the helmet.

BACKGROUND

Cycling, as a way of travel and sports, becomes more and more popular. And helmet becomes a standard configuration for a cycling hobbyist. In order to satisfy needs of different cycling hobbyists, the helmet is various. A kind of luminous helmet can emit light for both decoration and warning. In prior, aluminous helmet includes a light source, which is set on a surface of the luminous helmet or arranged in a groove defined from the surface into the luminous helmet. There are a variety of disadvantages of such luminous helmet, for example the luminous helmet may have a bad appearance because of the exposed light source and the exposed light source may be easily damaged as a result of external impact. In order to avoid these disadvantages, a helmet with hidden light sources is designed.

However, when manufacturing the helmet with hidden light sources, the light source is prone to be cracked and deformed because of a high temperature and pressure of an injection material. The injection material may be injected into the light source and cover a light emitting surface, which will result in poor light. Therefore, in actual production, a defective rate of the helmet with hidden light sources is very high.

BRIEF DESCRIPTION OF THE DRAWINGS

To illustrate the technical solution according to embodiments of the present disclosure more clearly, drawings to be used in the description of the embodiments are described in brief as follows. Obviously, the drawings in the following description are merely some embodiments of the present disclosure. It is to be noted that for those ordinarily skilled in the art, other drawings can be fetched according to these drawings without doing any creative work.

PREFERRED EMBODIMENTS

The technical solution in the embodiments of the present disclosure will be described clearly and completely accompanying with drawings of embodiments of the present disclosure as follows. Apparently, the described embodiments are only a part of the embodiments of the present disclosure, but not all the embodiments. Based on the embodiments of the present disclosure, all other embodiments achieved by those ordinarily skilled in the art without doing any creative work, should be included in the scope of the present disclosure.

Figure 1:
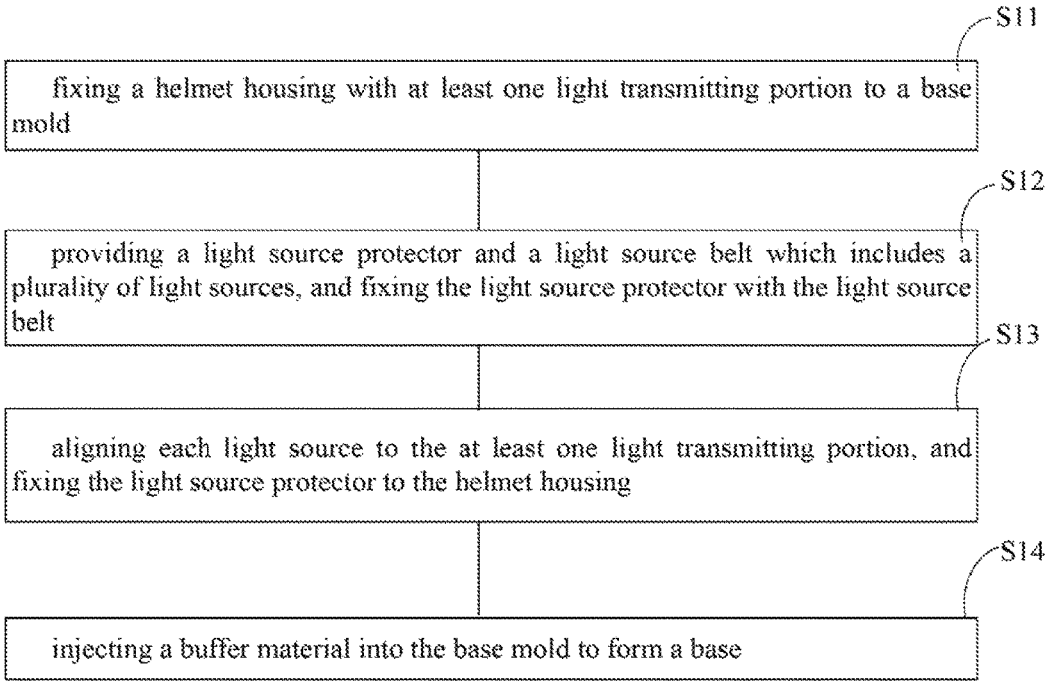
FIG. 1 is a flow chart of a method for manufacturing a helmet with hidden light sources, according to a first embodiment of the present invention.

Referring to FIG. 1, a method for manufacturing a helmet with hidden light sources according to a first embodiment of the present disclosure includes step S11 to step S14.

S11: fixing a helmet housing with at least one light transmitting portion to a base mold.

S12: providing a light source protector and a light source belt which includes a plurality of light sources, and fixing the light source protector with the light source belt.

S13: aligning each light source to the at least one light transmitting portion, and fixing the light source protector to the helmet housing.

S14: injecting a buffer material into the base mold to form a base.

Figure 2:
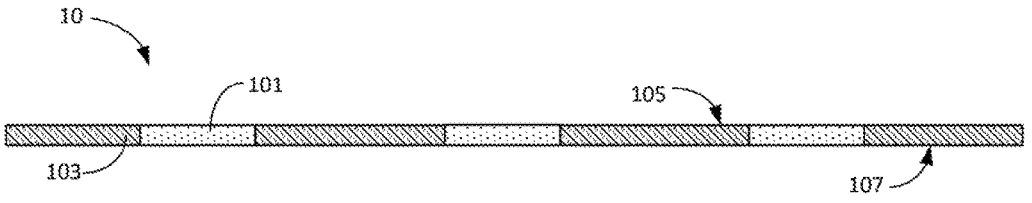
FIG. 2 is a cross sectional view of a helmet shell of the helmet with hidden light sources, according to the first embodiment of the present invention.

Referring to FIG. 2, in step S11, a helmet housing 10 is fixed on a base mold (not shown). The base mold is configured to form a base inside the helmet housing 10. The helmet housing 10 is preformed and includes at least one light transmitting portion 101 and the other lightproof portions 103. The helmet housing 10 has an outer surface 105 and an inner surface 107. The light transmitting portion 101 can be transparent or semitransparent. The lightproof portions 103 are opaque. The outer surface 105 is on the outside of the helmet housing 10. The inner surface 107 is on the inside of the helmet housing 10. In the present embodiment, the at least one light transmitting portion 101 includes a plurality of transmitting portions 101 arranged along a line as shown in FIG. 2. In other embodiments, the at least one light transmitting portion 101 maybe includes one elongated light transmitting portion 101, maybe includes three different shape light transmitting portions 101, or other suitable light transmitting portions 101.

Figure 3:
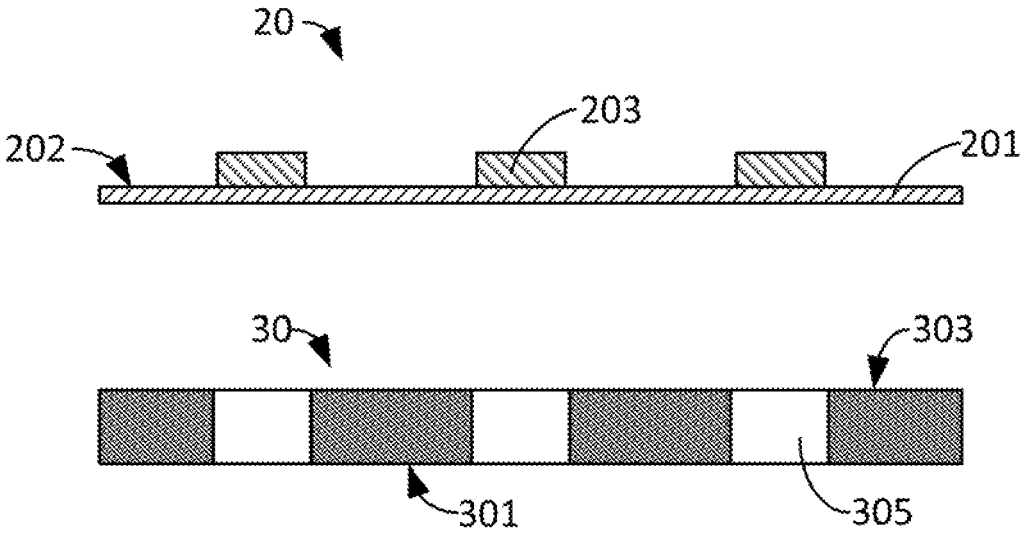
FIG. 3 is a cross sectional view of a light source protector and a light source belt of the helmet with hidden light sources, according to the first embodiment of the present invention.

Referring to FIG. 3, in step S12, a light source belt 20 and a light source protector 30 are provided. The light source belt 20 includes a circuit board 201 and a plurality of light sources 203. The light sources 203 are mounted on and electrically connected with the circuit board 201. The circuit board 201 can be a rigid printed circuit board or a flexible printed circuit board. The light sources 203 are arranged on a surface 202 of the circuit board 201. The light source protector 30 defines a plurality of accommodating holes 305 corresponding to the light sources 203 one by one. Each accommodating hole 305 corresponds to one light source 203. In the present embodiment, the light transmitting portions 101 correspond to the light sources 203 one by one. In another embodiment, each accommodating hole 305 can correspond to two or more light sources 203.

Figure 4:
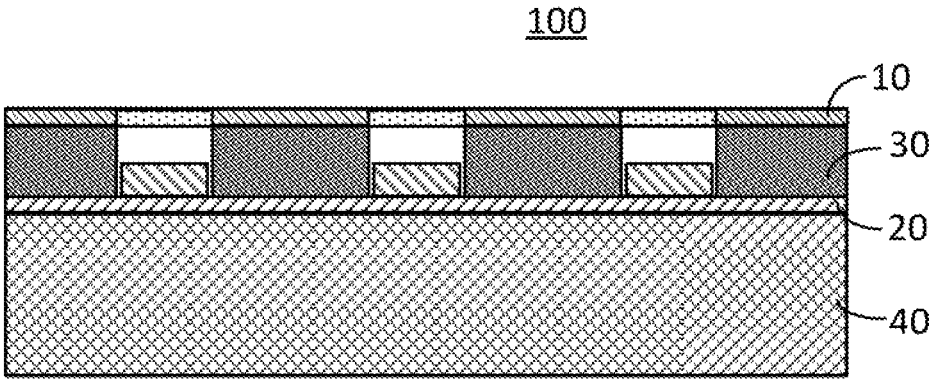
FIG. 4 is a cross sectional view of a helmet body manufactured by the method, according to the first embodiment of the present invention.

Referring to FIG. 4, the light source protector 30 is fixed to the light source belt 20, and the light sources 203 are aligned with the at least one light transmitting portion 101. For example, a first surface 301 of the light source protector 30 is coated with adhesive material, and then the adhesive material is cured and the light source belt 20 is bonded to the light source protector 30 via the adhesive material. After fixing the light source protector 30 to the light source belt 20, each light source 203 is received in a corresponding accommodating hole 305. As all light sources 203 are enclosed within the accommodating hole 305, the light source 203 can be protected from being damaged by an external impact.

Similarly, in S13, a second surface 303 of the light source protector 30 is attached with the helmet housing 10 via adhesive material.

The sequence of the steps S12 and S13 can be alternated as needed.

In another embodiment, the step S13 further includes attaching a first double side adhesive tape and a second double side adhesive tape on a first surface 301 and a second surface 303 of the light source protector 30 respectively. The step S14 further includes removing an isolation layer of the first double side adhesive tape and bonding the light source belt 20 to the first surface 301. The step S15 further includes removing an isolation layer of the second double side adhesive tape and bonding the helmet shell 10 to the second surface 303.

After the light source protector 30 and the light source belt 20 are fixed together, a buffer material can be injected into the base mold to form a base 40. The helmet housing 10, the light source belt 20, the light source protector 30, and the base 40 form a helmet 100. In other embodiment, the helmet 100 can be formed via other ways.

In above method, the light sources 203 are sealed in the accommodating holes 305, so that during the injection of forming the base 40, the light sources 203 can be prevented from cracking and deforming by high temperature and pressure of the injection material. Therefore a defective rate of the helmet with hidden light sources can be decreased.

Referring to FIG. 2 to FIG. 4, a helmet with hidden light sources 100 according to a second embodiment includes a helmet housing 10, a light source belt 20, a light source protector 30, and a base 40.

The helmet housing 10 includes a plurality of light transmitting portions 101 and the other lightproof portions 103. The helmet housing 10 has an outer surface 105, and an inner surface 107. The light transmitting portions 101 are arranged along a line and can be transparent or semitransparent. In one embodiment, the light transmitting portions 101 are located at a rear portion of the helmet housing 10. In another embodiment, the light transmitting portions 101 are arranged at both of the front and back side of the helmet housing 10. The lightproof portions 103 are opaque.

The light source belt 20 includes a circuit board 201 and a plurality of light sources 203 corresponding to the light transmitting portions 101 one by one. The light sources 203 are mounted on and electrically connected with the circuit board 201. The circuit board 201 can be a rigid printed circuit board or a flexible printed circuit board. The light sources 203 are arranged on a surface 202 of the circuit board 201. The light sources 203 can be light emitting diodes (LEDs) or organic light emitting diodes (OLEDs).

The light source protector 30 includes a first surface 301, a second surface 303 opposite to the first surface 301, and a plurality of accommodating holes 305 corresponding to the light transmitting portions 101 one by one. The accommodating holes 305 each penetrate through the first surface 301 and the second surface 303. The first surface 301 is bonded with the circuit board 201, and the second surface 303 is bonded with the inner surface 107. In the present embodiment, each light source 203 corresponds to an accommodating hole 305. Each light source 203 is received in a corresponding accommodating hole 305 and is aligned with a corresponding light transmitting portion 101.

A distance between the first surface 301 and the second surface 303 is not less than a height of each light source 203, so that the accommodating hole 305 can enclose and protect the light source 203.

In order to avoid non-preset light caused by interferences between each light source 203, preferably, the light source protector 30 can be made of shading material, such as black material. Therefore, each light source 203 emits light within a light scope defined by the accommodating hole 305. Preferably, the light source protector 30 is elastic to withstand the pressure during the injection so as to protect the light source. For example, the light source protector 30 can be made of ethylene-vinyl acetate copolymer (EVA) foam material or other elastic material.

The base 40 is in contact with the circuit board 201 as shown in FIG. 4, the side surface of the light source protector 30, and portions of the inner surface 107. In detail, one portion of the inner surface 107 contacts with the second surface 303, the other portions of the inner surface 107 contact with the base 40. FIG. 4 illustrates a cross section of a portion of the helmet 100 which comprises the light source 203, the light source protector 30, and the base 40. In the other portions of the helmet 100, the base 40 contacts the inner surface 107. The base 40 can be made of anti-impact material, such as Expanded Polystyrene (EPS).

Figure 5:
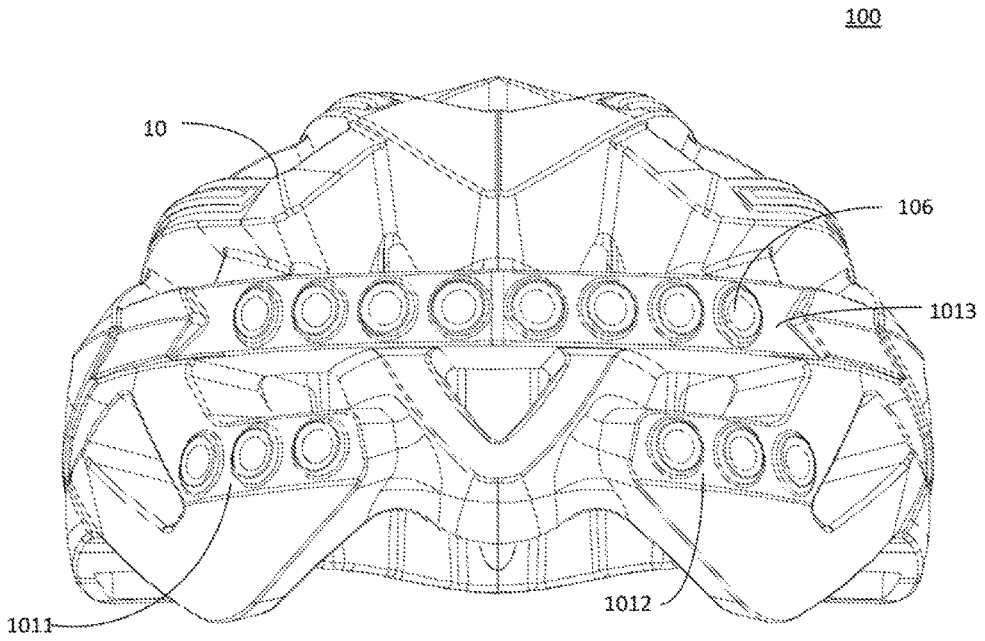
FIG. 5 is a rear view of a helmet with hidden light sources, according to another embodiment of the present invention.
Figure 6:
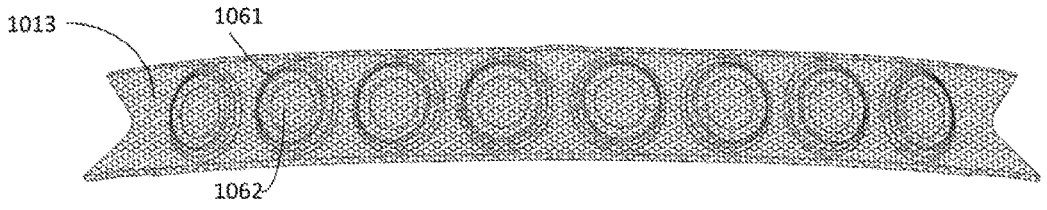
FIG. 6 is a schematic view of a light transmitting portion with a plurality of diffusion structures of the helmet of FIG. 5.

In the present embodiment, the light sources 203 are arranged along a line according to the light transmitting portions 101. In another embodiment as shown in FIG. 5 and FIG. 6, the light sources are distributed at different locations, the helmet housing 10 includes several light transmitting portions 1011 to 1013 arranged according to the light sources, and the helmet 100 includes several light source protectors arranged according to the light sources. In detail, the helmet housing 10 includes an above elongated light transmitting portion 1013 and two below symmetrical light transmitting portions 1011-1012. The above one light transmitting portion 1013 corresponds to eight light sources arranged along a line, the below light transmitting portions 1011-1012 each correspond to three light sources arranged along a line. Preferably, the shape of light source protectors matches the shape of the light transmitting portions 1011 to 1013. In order to further expand the scope of light, a plurality of diffusion structures 106 corresponding to light sources one by one can be formed at the light transmitting portions 1011 to 1013, as shown in FIG. 6. Each diffusion structure 106 can increase a light scope of a corresponding light source. Each diffusion structure 106 includes a protruding portion 1061, which defines a curved convex surface 1062. The shape of the diffusion structure 106 is not limited. In addition, as the light sources are hidden in the helmet, the light source cannot be seen from outside when the light source is off. Technical personnel in the field understand that the outer shape of the helmet 100 of the second embodiment is similar to the helmet 100 of FIG. 5, excepting the arrangement of the light transmitting portions 1011 to 1013.

Above all, each light source of the present embodiment is hidden in the helmet. That is, each light source is received in an accommodating hole, and is enclosed by the helmet shell, the light source protector, and circuit board so as to be prevented from being cracked and deformed by the high temperature and pressure injection, therefore the defective rate of the helmet with hidden light source can be decreased.

The contents described above are only preferred embodiments of the present disclosure, but the scope of the present disclosure is not limited to the embodiments. Any ordinarily skilled in the art would make any modifications or replacements to the embodiments in the scope of the present disclosure, and these modifications or replacements should be included in the scope of the present disclosure. Thus, the scope of the present disclosure should be subjected to the claims.

What is claimed is:

1. A method for manufacturing a helmet with hidden light sources, comprising:

fixing a helmet housing with at least one light transmitting portion to a base mold;

providing a light source protector and a light source belt, and fixing the light source protector to the light source belt, comprising:

coating adhesive material on a first surface of the light source protector and curing the adhesive material, wherein the light source belt comprises a circuit board and a plurality of light sources mounted thereon, wherein the light source protector comprises a plurality of accommodating holes corresponding to the light sources one by one, and the light sources each are received in a corresponding accommodating hole and enclosed by the light source protector and the circuit board;

aligning the light sources to the light transmitting portion and fixing the light source protector to an inner surface of the helmet housing; and injecting a buffer material into the base mold to form a base, wherein the base contacts with the circuit board and a portion of the helmet housing.

2. The method for manufacturing a helmet with hidden light sources of claim 1, wherein the step of fixing the light source protector to the helmet housing comprises coating adhesive material on a second surface of the light source protector and curing the adhesive material.

3. The method for manufacturing a helmet with hidden light sources of claim 1, wherein the light source protector comprises a first surface and a second surface opposite to the first surface; wherein the step of fixing the light source protector to the light source belt comprises attaching a first double side adhesive tape on the first surface, removing an isolation layer of the first double side adhesive tape, and bonding the circuit board to the first surface;

wherein the step of fixing the light source protector to the helmet housing comprises attaching a second double side adhesive tape on the second surface, removing an isolation layer of the second double side adhesive tape, and bonding the helmet housing to the second surface.

* * * * *